United States Patent [19]

Gilissen et al.

[11] Patent Number: 4,897,054

[45] Date of Patent: Jan. 30, 1990

[54] MODULAR CIRCUIT BOARD BUSSING CONNECTOR

[75] Inventors: Hermanus P. J. Gilissen, Esch; Lucas Soes, Rosmalen, both of Netherlands

[73] Assignee: AMP Incorporated, Harrisburg, Pa.

[21] Appl. No.: 323,169

[22] Filed: Mar. 15, 1989

Related U.S. Application Data

[63] Continuation of Ser. No. 134,630, Dec. 18, 1987, abandoned.

[30] Foreign Application Priority Data

Dec. 19, 1986 [GB] United Kingdom ..... 8630450

[51] Int. Cl.[4] ..... H01R 23/70

[52] U.S. Cl. ..... 439/631; 439/287; 439/493; 439/928

[58] Field of Search ..... 439/59–62, 439/67, 77, 629, 630, 631, 492–496, 928, 342, 345, 287

[56] References Cited

U.S. PATENT DOCUMENTS

| | | | |
|---|---|---|---|
| 2,904,768 | 9/1959 | Rasmussen | 439/631 |
| 3,333,231 | 7/1967 | Travis | 439/516 |
| 3,688,244 | 8/1972 | Sovoca et al. | 439/282 |
| 3,771,100 | 11/1973 | Reed . | |
| 3,771,104 | 11/1973 | Clark . | |
| 3,851,297 | 11/1974 | Munro . | |
| 3,930,308 | 1/1976 | Munro | 29/879 |
| 3,934,959 | 1/1976 | Gilissen | 439/77 |
| 3,954,317 | 5/1976 | Gilissen et al. | 439/591 |
| 3,985,413 | 10/1976 | Evans | 439/66 |
| 4,133,592 | 1/1979 | Cobaugh et al. | 439/74 |
| 4,199,209 | 4/1980 | Cherian et al. | 439/591 |
| 4,203,203 | 5/1980 | Gilissen et al. | 439/77 |
| 4,220,382 | 9/1980 | Ritchie et al. | 439/61 |
| 4,322,120 | 3/1982 | Rilling | 439/631 |
| 4,401,351 | 8/1983 | Record | 439/61 |
| 4,475,781 | 10/1984 | Asick et al. | 439/61 |
| 4,489,998 | 12/1984 | Asick et al. | 439/62 |
| 4,636,018 | 1/1987 | Stillie | 439/66 |
| 4,693,529 | 9/1987 | Stillie | 439/67 |

FOREIGN PATENT DOCUMENTS 2036464 6/1980 United Kingdom .

*Primary Examiner*—Neil Abrams
*Attorney, Agent, or Firm*—Eric J. Groen

[57] ABSTRACT

A modular mother board or bus printed circuit board connector includes insulating housings, each having a row of contact receiving channels extending between longitudinal edges and intersecting a daughter board receiving slot. Flat stamped contact elements inserted in the channels have first and second resilient contact portions at opposite edges and resilient daughter board engaging contacts protruding into the slot. A bridge portion severable at different locations joins the first and second contact portions. The longitudinal edges of adjacent housings are adapted to be attached together to bring corresponding first and second contact portions into electrical engagement to effect desired combinations of connection both between adjacent modules and the daughter boards according to the locations at which the bridge portion is severed.

20 Claims, 7 Drawing Sheets

11
12
13
15
16
17
19
20
21
22
23
24
26
27
28
31
32
33
34
35
37
38
41
42
43
44
48
49
51
52
53
54
55
57
58
61
62
65
66
Z
X
Y
-Y
-X
-Z

MODULAR CIRCUIT BOARD BUSSING CONNECTOR

This application is a continuation of application Ser. No. 07/134,630 filed Dec. 18, 1987, now abandoned.

BACKGROUND OF THE INVENTION

1. Field of the Invention

The invention relates to a modular circuit board bussing connector and to a contact element therefor.

2. Description of the Prior Art

There is an increasing requirement to provide automated process control in various production units (such as wire E.D.M. equipment). However, in the interests of minimizing capital outlay, the user desires initially to install a relatively inexpensive unit which provides only basic control functions and to have the capacity for expansion when justified at a later date.

In order to enable such future expansion, the user is normally provided with one or more daughter boards mounted on connectors on a mother or buss board on which several further connectors are mounted to accommodate additional daughter boards when required, to permit increase in capacity of the system. However, the provision of the further connectors increases the initial capital expenditure, while the fixed design of further connectors may also impose limitations on the connections possible to the further printed daughter boards which may undesirably limit the types that can be used.

An electrical connection system is disclosed in U.S. Pat. No. 4,322,120 for the distribution of power and data signals to and from insulative substrates carrying conductive traces thereon and including a plurality of insulative housing means where each have opposed parallel ends and, on one face, a circuit board receiving slot disposed between and parallel to said ends. The housing means also include printed circuit board receptacle contacts disposed in the printed circuit board receiving slots and have bussing means extending between the opposite ends.

SUMMARY OF THE INVENTION

According to the invention, the electrical connection system is characterized by the bussing means having formed at each of the ends resilient contact portions arranged for abutting face-to-face engagement with complementary resilient contact portions of a similar insulative housing when the housings are disposed in end-to-end abutting relation.

Thus, additional connector modules need be added only when required, thereby avoiding the initial capital expenditure required with former proposals. In addition, selective severing of the bridge portion before or after insertion of the contact elements into the housing enables different combinations of connections both to the circuit board and the adjacent modules and circuit board connected therein.

In one version of the connector module, the housing includes contact element receiving channels and the contact elements comprise metal stampings formed with first and second contact portions at respective opposite ends. In a preferred example, a pin portion extends from the bridge at a medial location and out of the housing for enabling a tap or shunt connection to a similar pin portion of a contact element in an adjacent slot of the same module, the bridge being severable on either side of the pin portion to isolate either the first or the second contact portions both from the pin portion and from the second or first contact portion respectively.

The provision of the pin portion enables a further combination of connections to the circuit board paths to be obtained by shunting adjacent contact elements of the same connector module.

It is further preferred that the further board engaging contact spring means comprises two contact springs extending from opposite ends of the severable bridge portion, respectively, adjacent the first and second contact portions and between them defining an edge connector for engaging conductive paths on opposite sides of a circuit board.

It is also preferred that one of the further board engaging contact springs is joined to the bridge adjacent the second contact spring by a severable portion and a tool receiving recess extends along the housing across which recess the severable portion extends.

It will be apparent that selective severing of the bridge on either side of the pin portion, in combination with the capability of both severing the severable portion of the second contact spring and selective shunting to adjacent contact elements, enables a large permutation of different connections to be obtained.

A second embodiment of connector bussing system includes a flexible substrate which is applied to the housing, the substrate has a plurality of circuit traces thereon, with the flexible substrate and at least a portion of the circuit traces extending to the longitudinal edges thereof where the longitudinal edges include interconnection means for mechanical interconnection to a like housing. The like housing including a similar substrate with the substrate similarly overlapped at the mating longitudinal edge such that the interconnection between the two housings mechanically lock the two housings together and electrically interconnect at least a portion of the printed circuit board edge traces.

The preferred version of the second embodiment has at least one of the longitudinal edges including an elastomeric insert disposed beneath the substrate and the electrical traces along the end edges thereof being resiliently biased against respective traces on the matable printed circuit board. It is further preferred that each longitudinal edge includes a recessed portion with an elastomeric insert positioned within each of the recesses, the inserts being deformable to the extent of abutment with interconnectable end edges.

The modules of either embodiment may be assembled together by means of a mounting rail and/or have longitudinal edges provided with latches or complementary mating portions to secure them together.

BRIEF DESCRIPTION OF THE DRAWINGS

An example of the invention will now be described with reference to the accompanying drawing in which:

FIG. 3 is a similar view to FIG. 2 indicating schematically various connections to the circuit board that can be obtained by selective severing and shunting adjacent contact elements.

FIG. 5 is a cross sectional view substantially through lines 5—5 of FIG. 4, showing a second housing assembly poised for reception into a first housing.

DETAILED DESCRIPTION OF THE PREFERRED EMBODIMENT

Figure 1:
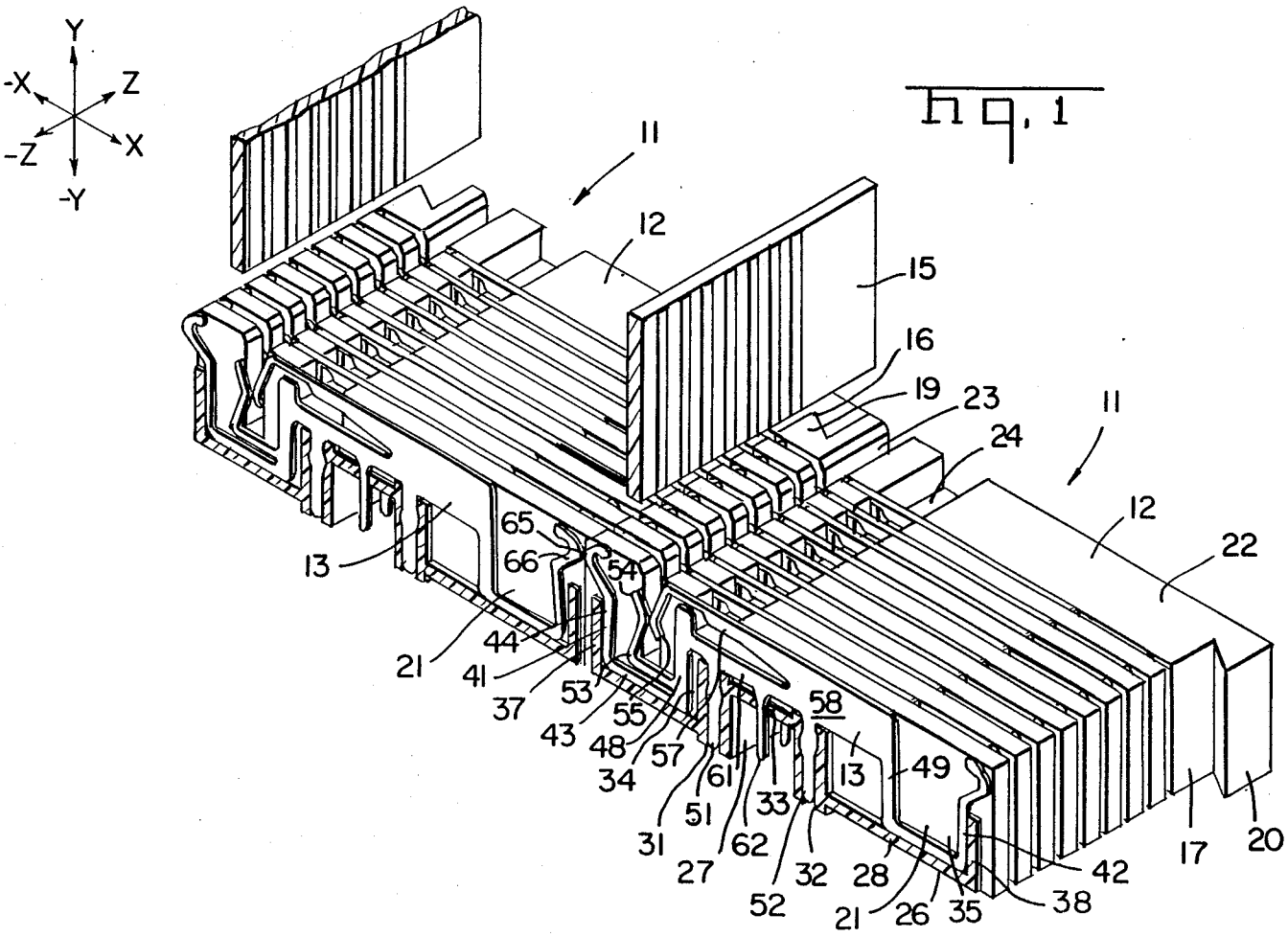
FIG. 1 is a fragmentary perspective view, partly in cross section, of two connector modules assembled together.

As shown particularly in FIG. 1, each connector module 11 of the first embodiment comprises a housing 12 molded in one piece of suitably rigid plastic material carrying a row of identical, flat, stamped, metal contact elements 13.

Each housing module 12 is formed as a block, rectangular in plan, in practice being elongate in the direction of extension Z of a mating printed circuit board edge 15. First and second opposite longitudinal edges of the block 16 and 17, respectively, are formed respectively with complementary male and female dovetail joints 19 and 20, respectively, for attachment of adjacent modules 11, in edge-to-edge relation, and a row of contact element receiving channels 21 opening to a board receiving face 22 extend from edge to edge such that on attachment together of adjacent modules 11, corresponding channels 21 will be brought into end-to-end alignment. Each channel 21 is intersected by a relatively deep, board receiving slot 23 and a relatively shallow, tool admitting recess 24 extending along the board receiving face 22, parallel to each other and adjacent, but successively spaced from the first longitudinal edge 16 and opening to the face 22. The opposite face 26 of the housing module 12 is formed at a generally central location with a similarly oriented, channel-section, connector receiving recess 27. A base wall 28 of each channel 21 is discontinuous, parallel wall portions defining a contact element anchoring socket 31, 32 on each longitudinal side of the connector receiving recess 27 and a contact pin receiving aperture 33 centrally of the recess. On each side of the recess the channels define contact spring cavities 34 and 35, respectively, of increased depth, located adjacent but spaced from respective opposite longitudinal edges 16 and 17 of the housing by contact spring retaining end wall portions 37 and 38, respectively, extending from the base wall part way towards the connector receiving face 22, permitting engagement of aligned contact elements of adjacent modules when assembled together.

Each contact element 13 comprises substantially identical first and second, oppositely directed, cantilever spring contacts 41 and 42 at respective ends, each comprising first and second orthogonally arranged spring beam elements 43 and 44 extending from stiffly resilient vertical stems 45 and 49, respectively, joined to first and second anchoring posts 51 and 52. A generally right-angled cantilever spring arm 53 is joined to the first stem 51 to extend towards the first spring contact and has a reversely inclined first printed circuit board contact portion 54 at a free end located in spaced opposed relation to a second printed circuit board contact portion 55 extending from a cantilever beam spring element 56 joined by a severable portion 57 both to the second anchoring post 52 and merging with a relatively massive stabilizing body portion 58. The first and second anchoring portions are joined by a severable bridge 61 from a central location of which extends a contact pin 62.

It should be noted that the cantilever beam elements may be of progressively decreasing width as they extend to the free contact ends to ensure a desirably progressive increase in spring stiffness with increasing deflection.

When assembling the module, the contact elements 13 are stitched either entirely into respectively channels 21 as shown in FIG. 1, or, after the bridge 61 is selectively severed on either side of the contact pin 62, to provide various interconnections to the paths on the printed circuit board 15 as described below. In addition, the portion 57 may also be severed after receipt in the housing to remove the second printed circuit board contact portion 55 when connection to only one side of the printed circuit board 15 is required.

When stitched into these channels, the first and second contact springs 41 and 42, respectively, are located in the cavities 34 and 35 by the anchoring posts being force-fitted in the sockets so that the first contact portion 65 protrudes beyond the first edge of the housing, and the first and second printed circuit board contact portions 54 and 55 protrude into the printed circuit board receiving slot 23 for electrical connection to paths on respective opposite sides of a printed circuit board inserted into the slot. The severable portion 57 extends across the tool receiving recess 24.

Some of the possible interconnections will now be described with reference to the drawings in which P1 and P2 designate adjacent paths on the same face of a circuit board, while P3 and P4 designate paths on the opposite face aligned with paths P1 and P2, respectively.

Figure 2:
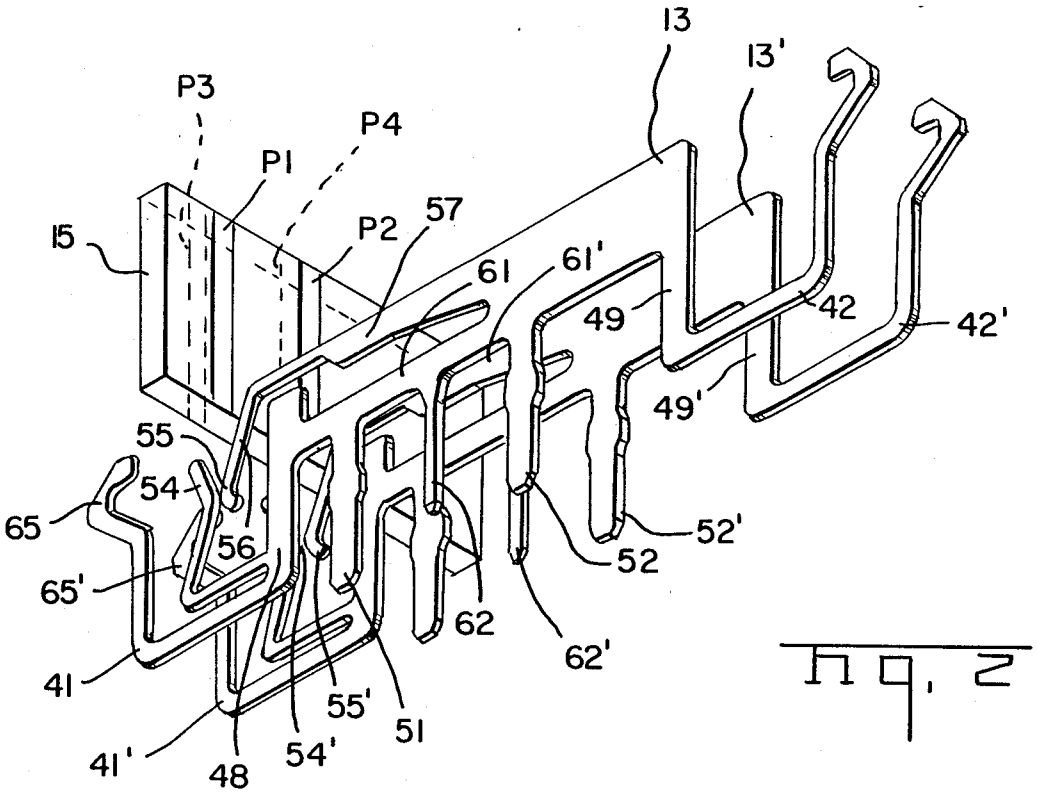
FIG. 2 is a perspective schematic view of adjacent contact elements aligned with conductive paths of a printed circuit board.

As shown in FIG. 2, in the entire contact element, the bridges 61, 61′ are unsevered resulting in contact portions 54 and 55 connecting both P1 and P3 to both the spring contacts 41 and 42 at each end of the contact element and therefore to aligned contact elements of any adjacent modules assembled therewith. Connection of the pins 62 and 62′ by a shunt, as shown in phantom FIG. 3, connects all paths P1–P4 to both adjacent contact elements 13, 13′.

As shown in phantom FIG. 3, the bridge 61 of contact element 11 can be severed to the left of the pin 62, isolating contact springs 41 and 42, resulting in P1 being connected only to contact spring 42, while P2 is connected only to contact spring 41. When the pins 62 and 62′ are shunted, as shown in phantom, P1 is also connected to both contact springs 41′ and 42′ of contact element 13′, and thereby both to P2 and P4 of the circuit board.

FIG. 3 also illustrates that the bridge 61 of contact element 13 can be severed to the right of pin 62, providing the same connections as aforementioned. However, when pins 62 and 62′ are shunted, P1 is connected to 42 only. P2 is connected to 41, 41′ and 42′, and P3 is connected to both contact springs 41′ and 42′ of contact element 13′ and thereby to both P2 and P4.

As will be observed from a careful study of FIG. 3, many combinations of interconnection can be obtained through the severing of bridges 61 and 61' and, in addition, by severing arm portions 57 or 57' to remove contact portions 55 or 55', isolating P1 and P2 after the contact elements have been mounted in the housing module.

In an alternative example (not shown), the pin 62 is replaced by a conventional wire receiving slot into which a wire can be forced to effect connection therewith.

Figure 4:
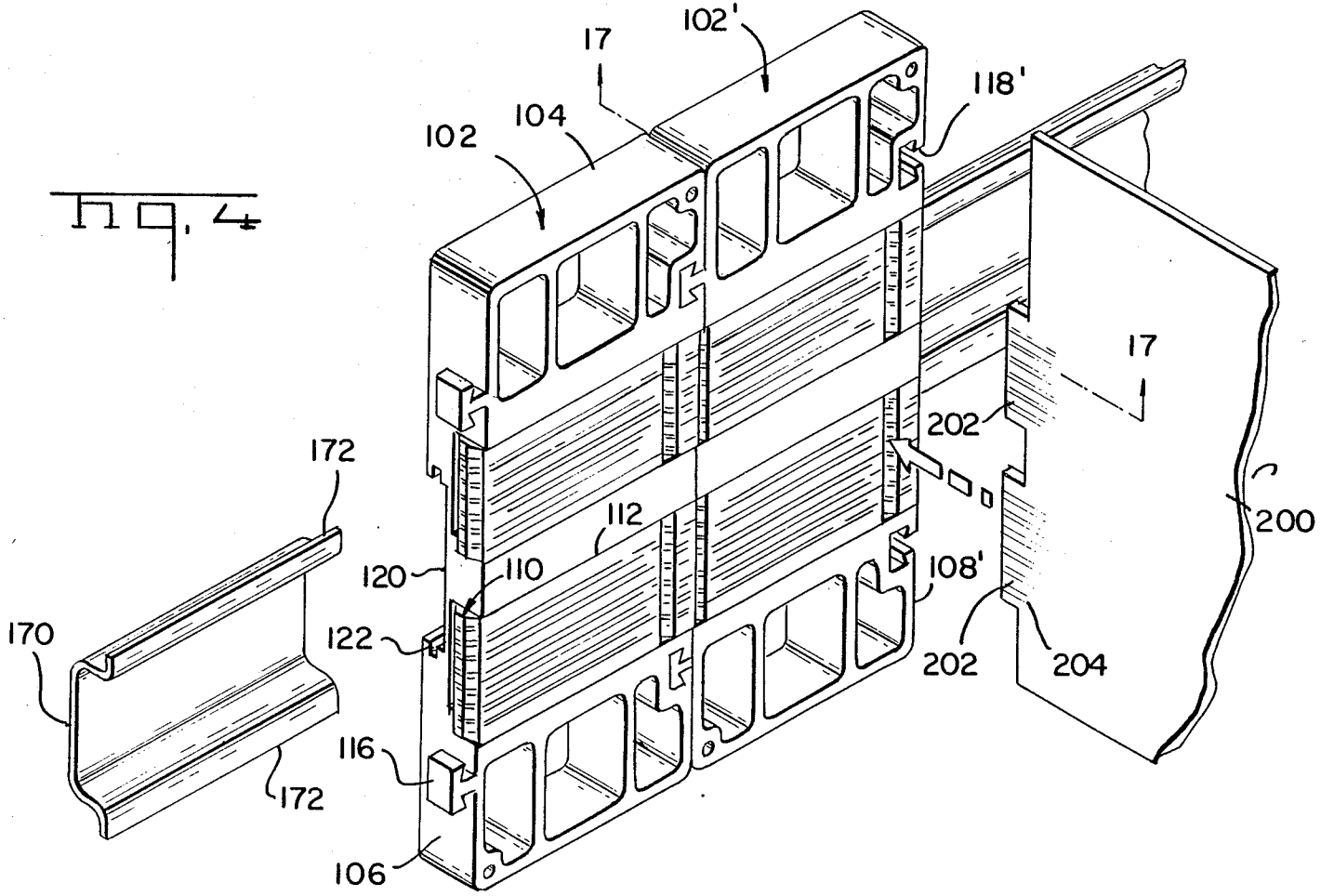
FIG. 4 is an isometric view of another embodiment of modular bussing system showing two modular housings mechanically interconnected with a printed circuit card shown poised for receipt within the slots which form an entry for the edge guide of the printed circuit board.
Figure 7:
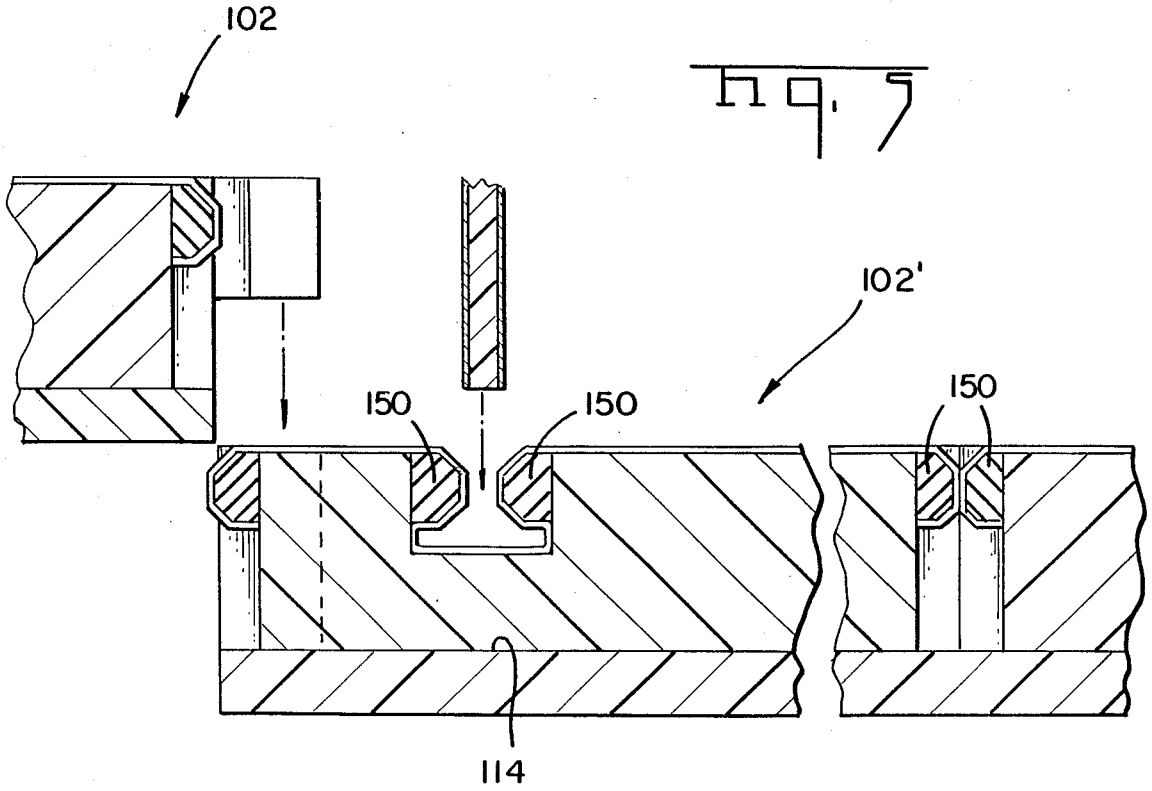

With reference first to FIG. 4, the second embodiment of the modular connector system includes a modular connector assembly, shown generally as 102 including an insulative housing such as 104 having endwalls 106 and 108. Extending between the endwalls 106 and 108 is a recess such as 110 having sidewalls 112 and a floor 114 (FIG. 5). The sidewalls 106 and 108 further include dove tail extensions 116 and dove tail slots 118 respectively for mechanically interconnecting two identical housing members. FIG. 4 also shows that a slot such as 120 which is provided on the underside of the insulative housing 104 which includes a groove such as 122 for receiving side edges 172 of the locking rail 170. It should be noted that when the two housings are locked together with the dove tail extensions within the dove tail slots, and the locking rail 170 in place within the slot 120, the modular connectors are securely fastened together as the modular connector housings are locked together in two different axes.

Figure 6:
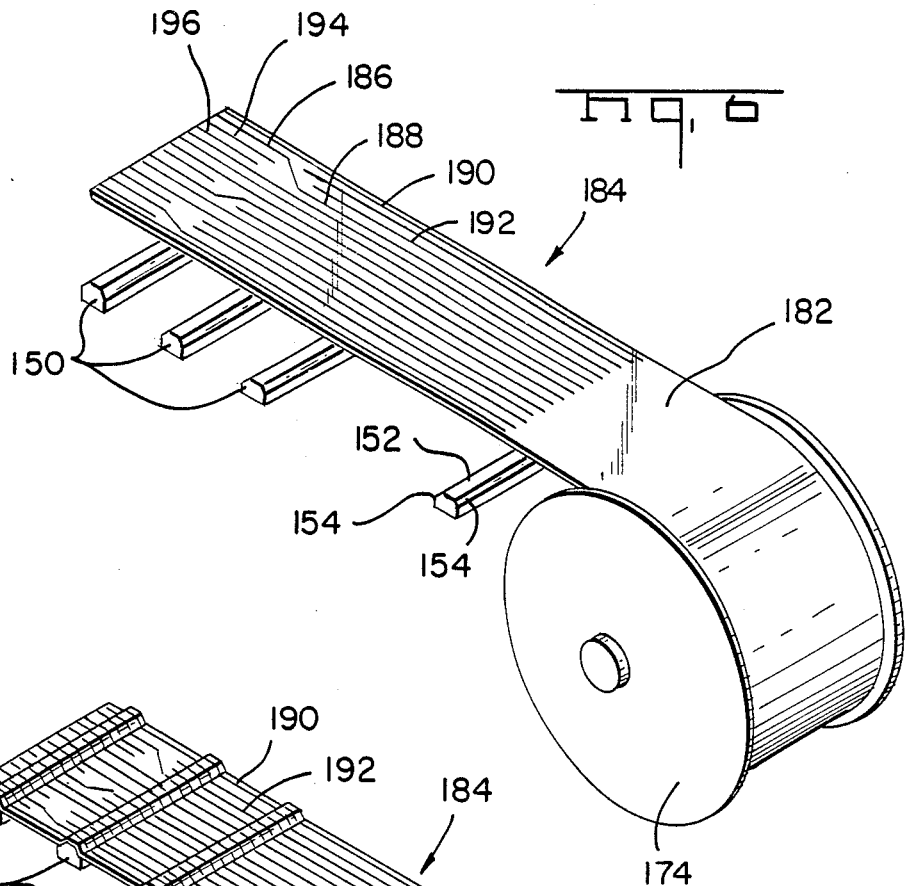
FIG. 6 is a view showing the continuous reel of flexible substrate which forms the modular connector subassemblies poised for receipt over the elastomeric inserts.
Figure 7:
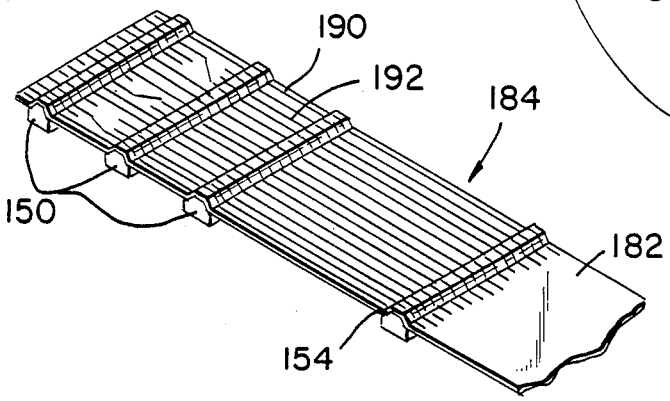

With reference now to FIG. 6, a connector subassembly will be formed from a continuous flexible substrate such as 182 which is removed from a reel such as 174. The flexible substrate 182 includes electrical traces generally shown as 184 in FIG. 6. The continuous flexible substrate is unrolled from the reel 174 and placed in juxtaposition over a plurality of elastomeric inserts such as 150. It should be noted from FIG. 6 that the elastomeric inserts include a planar surface such as 152 and two angled surfaces such as 154 which digress away from the planar surface 152. With the flexible substrate properly aligned over the elastomeric inserts, the flexible substrate 182 can be heat fused or adhesively fixed to the elastomeric inserts with the flexible substrate 182 conforming to the shape of the planar surface and the angled surfaces 154.

Figure 7:
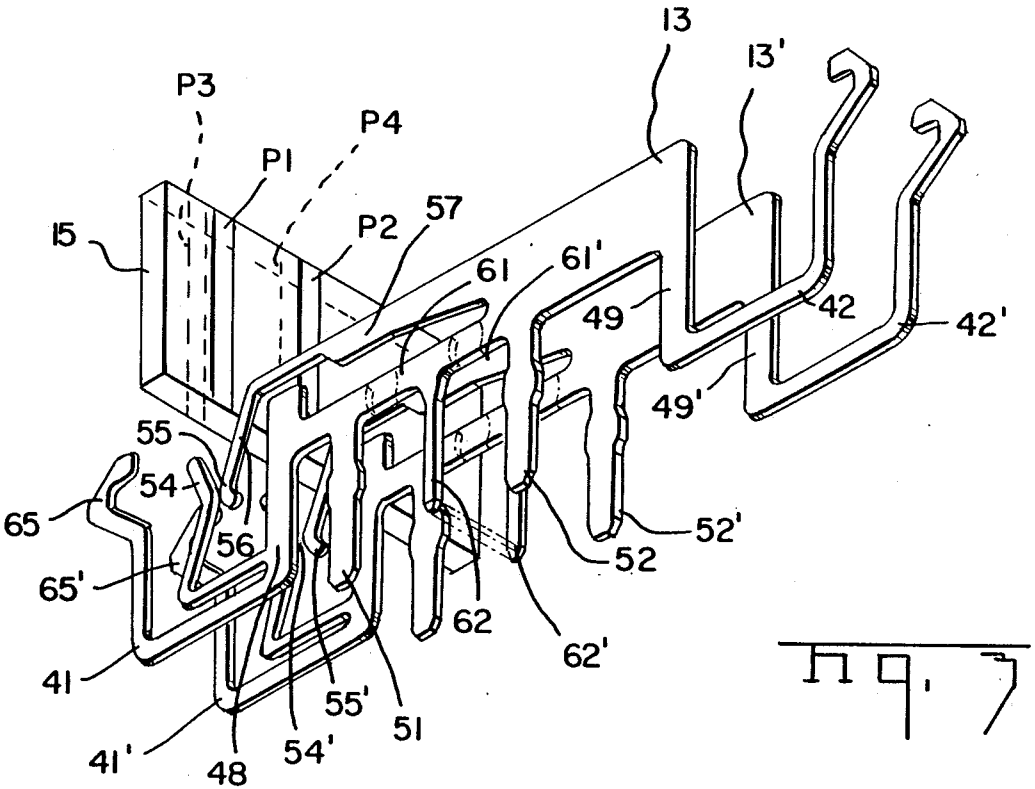
FIG. 7 shows the flexible substrate after it has been heat fused or adhesively interconnected to the elastomeric inserts.
Figure 8:
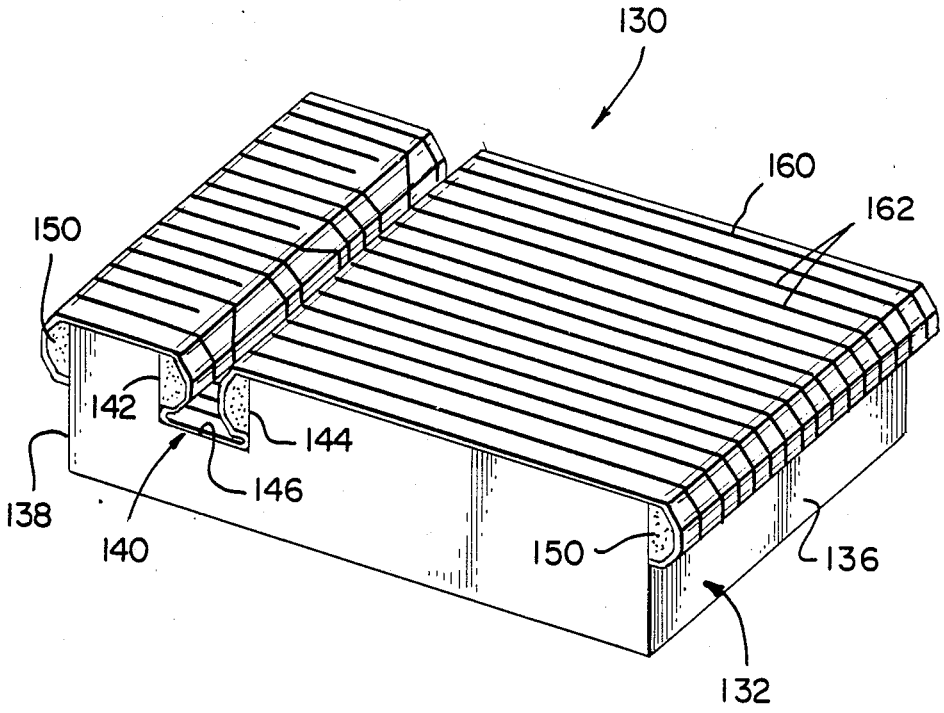
FIG. 8 is an isometric view of the assembled elastomeric connector subassembly.

With the flexible substrate 182 securely fixed to the elastomeric inserts, the elastomeric inserts and the flexible substrate can be adhesively fixed to the insulative block which is shown as 132 in FIG. 8. It should be noted that the elastomeric inserts 150 are spaced appropriately to allow the flexible substrate to conform to the configuration as shown in FIG. 8. It is desirous to have the flexible substrate lying along the top of the planar surface of the insulative block 132, yet draping into a recess such as 140 with the elastomeric inserts adhesively fixed to the side walls 142, 144 of the recess 140 with the planar surfaces of the recess in facing opposition with the flexible substrate between the two inserts conforming along the floor 146 of the recess 140. It should also be noted that one insert 150 and a flexible substrate partially overlapping the insert 150 is affixed to an end wall such as 136 of the housing block 132 while a second elastomeric insert 150 with a second overlapping end of the flexible substrate is affixed to an end wall such as 138. It should also be noted that bussing portions such as 160 and 162 extend between opposite end walls. Once the insulative block has the flexible substrate attached thereto, the insulative block 132 is insertable within the recess 110 and adhesively fixed therein. It should be noted that the block 132 and the housing 104 could be formed integrally into a single unitary component. As shown in FIGS. 4 and 5, the elastomeric inserts which are affixed to the end walls 136 and 138 of the insulative block 132 are somewhat recessed within the end walls 106 and 108 of the housing 104, yet the planar surfaces 152 of the elastomeric inserts extend beyond the end walls 106 and 108. In this manner, as shown in FIG. 5, a first insulative housing such as 102 is aligned with an identical connector housing such as 2', the elastomeric inserts along the end walls 106 and 108 will be in a resiliently biased electrical interconnection. Furthermore, the two inserts 150 which are adhesively affixed within the recess 140 form an electrical connector for interconnecting a printed circuit board such as 200 which includes edge guides 202 (FIG. 4) having circuit traces such as 204 extending to the edge guides 202. It should be noted from FIG. 6 that the flexible circuit 182 includes a programming feature which can allow electrical interconnection between two traces on opposite sides of a printed circuit board where the two traces are not aligned and the two traces jumper at least one intermediate trace. More specifically, the flexible substrates includes a trace such as 186 which is aligned with trace 190, although trace 186 and 190 are not electrically interconnected together but are rather discontinuous at the area of the flexible substrate which drapes into the recess 140. Rather, trace 186 is interconnected to trace 188 jumpering trace 192. Trace 194 and trace 192 are still in line as are trace 188 and 196. As the flexible substrate 182 conforms to the elastomeric inserts 150 such as shown in FIG. 7, and installed within a recess 140 as shown in FIG. 8, the jumper portions are tucked away under the inserts 150 and cannot be contacted by the printed circuit board during the insertion of the board. In this manner, traces 194 and 196 can still be used as electrical interconnections to associated traces on a first side of a printed circuit board and traces 190 and 192 can be used for electrical interconnection on opposite sides of the printed circuit board. Traces 186 and 188 jumper traces 192 and 194 to electrically interconnect associated traces on opposite sides of the printed circuit board which are not aligned.

It should be noted from FIGS. 1 and 4 that the modular connectors such as 11 and 102 are expandable to any degree. The modular connectors such as 11 and 102 are advantageous in equipment in which several options are required where the options are not always supplied by the manufacturer, as standard equipment. The subject invention would be used as a modular power buss system and as a modular printed circuit board. Options can be added on to equipment by the manufacturer or by the end user, by simply expanding the electrical interconnection between two modular connectors and by inserting the logic to the options via the printed circuit boards 15 and 200.

We claim:

1. An electrical connector comprising an insulating module having a printed circuit board receiving slot therein with a plurality of receptacle contacts disposed within the slot, the module having a series of bussing means extending between opposed parallel ends of the module and intersecting the circuit board receiving slot, the bussing means being selectively commoned to the receptacle contacts, the bussing means being defined with at least one resilient contact portion arranged to protrude beyond one of the opposed parallel ends of the housing, with the opposed parallel ends of the housing being adapted to be assembled in edge-to-edge relation with another similar connector module to bring complementary conductive contact portions into electrical engagement to selectively interconnect receptacle contacts on similar modules, the receptacle contacts and the bussing means being formed by circuit traces disposed on a flexible substrate, the flexible substrate being applied to the module with the circuit traces extending between opposed parallel ends and extending into the circuit board receiving slot for electrical interconnection to the printed circuit board traces.

2. The electrical connector of claim 1 wherein elastomeric inserts are disposed beneath the flexible substrate adjacent to the circuit board receiving slot on opposed parallel surfaces of the slot and beneath the flexible substrate on the opposed parallel ends.

3. In an electrical system including at least one electrical connector for interconnection to at least one connectable edge card, where the electrical connector comprises a housing means and an elastomeric insert fixedly mounted relative to the housing means, and a flexible substrate in at least a partially surrounding relationship with the elastomeric insert, the substrate including a plurality of circuit traces disposed on an exterior surface of the substrate for electrical connection with associated traces on the edge card, the system being modular in nature, comprising a plurality of modules, each module being interconnectable to other similar modules to expand the system, the substrate, and the traces thereon, extending to the exterior surface for overlapping interconnection to traces on a similar substrate of the similar housing means.

4. A printed circuit board according to claim 3 wherein the housing means comprises a base portion having side edges and end edges, and the at least one surface is an end edge of the base portion.

5. A printed circuit board according to claim 4 wherein the substrate extends to each of the end edges for interconnection to like traces on a similar printed circuit board which can be abutted to the printed circuit board.

6. A printed circuit board according to claim 3 wherein the interconnection means comprises mating profiles along the end edges for interconnecting the base portion to an identical base portion of another printed circuit board.

7. A printed circuit board according to claim 6 wherein one end edge includes a dovetail extension while the opposing end edge includes a dovetail slot, the extension and slot being matably interconnectable to respective slots and extensions in a base portion of a matable printed circuit board.

8. A printed circuit board according to claim 4 wherein at least one of the end edges includes an elastomeric insert disposed beneath the substrate, the electrical traces along the end edges thereof being resiliently biased against respective traces on the matable printed circuit board.

9. A printed circuit board according to claim 4 wherein each end edge includes a recessed portion with an elastomeric insert positioned within each of the recesses, the inserts being deformable to the extent of abutment with interconnectable end edges.

10. An electrical connection system for the distribution of electrical signals, to and from insulative substrates carrying conductive traces thereon and including a plurality of insulative housings each having opposed vertical parallel ends and a vertical circuit board receiving slot disposed between said opposed parallel ends, and printed circuit board receptacle contacts disposed in said printed circuit board receiving slot having bussing means extending between said opposed parallel ends, said bussing means being formed at each of the said ends with generally vertically extending resilient contact portions extending beyond said opposed vertical parallel ends and profiled for slidable abutting engagement with complementary resilient contact portions of a similar insulative housing when said housings are moved vertically relative to each other into end-to-end abutting relation.

11. The electrical connection system of claim 10 wherein the generally vertically extending resilient contact portions are generally convex in shape extending beyond the opposed vertical parallel ends.

12. The electrical connection system of claim 11 wherein selected surfaces of the insulative housing means have latching structures which are complementary with latching structures on the selected surfaces of the similar insulative housing means and the bussing means is disposed adjacent to the selected surfaces for electrical interconnection to similar conductive busses on connectable insulative housing means.

13. The electrical connector of claim 12 wherein the latching structures are vertically extending and located on opposed vertical parallel ends of the housings, such that vertical movement of two housings relative to each other, latches the two housings together and brings the complementary resilient contact portions into electrical engagement.

14. The electrical connection system of claim 13 wherein the latching structures are formed as dovetail extensions and dovetail slots.

15. The electrical connection system of claim 10, wherein the receptacle contacts include means to selectively common between receptacle contacts of the same insulating block.

16. The electrical connection system of claim 10, wherein the receptacle contacts comprise conductive traces disposed on a flexible substrate on each housing, where the substrates overlie resilient elastomeric material, the substrates and the elastomeric material being disposed on the insulative housing means adjacent to the parallel ends to form opposed contacting surfaces, whereby the insulative housings may be abutted in end-to-end relation to interconnect the conductive traces of the abutted housings.

17. The electrical connection system of claim 10, wherein the receptacle contacts are stamped from flat metallic plates.

18. An electrical connection system comprising at least two insulating modules each having a series of bussing means extending between opposed vertical parallel ends of the module and intersecting a vertical circuit board receiving slot within the module, the bussing means being selectively commoned to the receptacle contacts, the bussing means being defined with at least one resilient contact portion arranged to protrude beyond one of the opposed vertical parallel ends of the module, with the opposed vertical parallel ends of the module being adapted to be assembled in edge-to-edge relation with another similar connector module to bring said resilient contact portions into complementary electrical engagement to selectively interconnect receptacle contacts on similar modules, the opposed vertical parallel ends of a first insulating module having latching structures which are complementary with latching structures on opposed vertical parallel ends of a second insulating module for latching engagement into electrical interconnection of similar bussing means on the first and second modules, the latching structures of the first and second modules extending vertically and located on opposed vertical parallel ends of the modules, such that vertical movement of the two modules relative to each other latches the two modules together and brings the resilient contact portions into electrical engagement.

19. The electrical connection system of claim 18 wherein the resilient contact portions are generally vertically extending for sliding engagement during vertical movement of the two modules together.

20. The electrical connection system of claim 18 wherein the receptacle contacts include first and second contact elements being joined by an optional bridge portion where upon omittance, one bussing portion is isolated from the other and from the board engaging contact elements.

* * * * *